US007492384B2

(12) United States Patent
Takahashi

(10) Patent No.: US 7,492,384 B2
(45) Date of Patent: Feb. 17, 2009

(54) PLATEN RETAINING STRUCTURE AND RECORDING UNIT

(75) Inventor: Masanori Takahashi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/008,285

(22) Filed: Jan. 10, 2008

(65) Prior Publication Data

US 2008/0180468 A1 Jul. 31, 2008

(30) Foreign Application Priority Data

Jan. 25, 2007 (JP) ..... 2007-015239

(51) Int. Cl.
*B41J 11/00* (2006.01)
*B41J 11/02* (2006.01)

(52) U.S. Cl. ..... 347/220

(58) Field of Classification Search ..... 347/220, 347/222, 218; 400/649, 651, 653
See application file for complete search history.

(56) References Cited

U.S. PATENT DOCUMENTS

| | | | | |
|---|---|---|---|---|
| 6,078,345 | A * | 6/2000 | Yamakawa et al. | 347/218 |
| 6,249,302 | B1 * | 6/2001 | Sekiya | 347/220 |
| 2003/0058327 | A1 * | 3/2003 | Louis | 347/220 |
| 2005/0232679 | A1 * | 10/2005 | Na et al. | 400/649 |
| 2006/0001730 | A1 * | 1/2006 | Sawai | 347/220 |

* cited by examiner

*Primary Examiner*—K. Feggins
(74) *Attorney, Agent, or Firm*—Adams & Wilks

(57) ABSTRACT

A shaft portion 2*a* of a platen roller 2 is inserted into an elongated hole-like recess 5*a* of a platen frame 5 so as to be movable therein. A release arm 9 having an engagement portion 9*b* engaged with a shaft portion 2*a* is swingably provided and is urged by a spring member 10. A switch 11 has an intercept 11*a* which can be contacted/separated to/from the release arm 9. When a thermal head 1 is moved against a spring force of a spring member 4, the release arm 9 follows the thermal head 1 to be allowed to swing by the spring member 10, thereby moving the shaft portion 2*a* in the recess 5*a*. When the switch 1 detects movement of the release arm 9, it is determined that recording is impossible since the thermal head 1 and the platen roller 2 are spaced apart from each other.

6 Claims, 7 Drawing Sheets

PLATEN RETAINING STRUCTURE AND RECORDING UNIT

FIELD OF THE INVENTION

The present invention relates to a retaining structure for a platen roller used at a position in contact with a head, and a recording unit including the same.

DESCRIPTION OF THE RELATED ART

Conventionally, there is a recording unit having inside a casing a recording head and a roller-type platen (platen roller.) being in contact therewith, with the recording head performing recording on a recording medium (sheet material) transported by the platen roller. In general, the recording head and the platen roller are fixed to be held in contact with each other, and during recording, the recording medium is inserted between the recording head and the platen roller, and recording is performed by the recording head while transporting the recording medium through rotation of the platen roller. In the recording unit, in a case of performing operations such as setting of the recording medium by inserting it between the recording head and the platen roller, jam treatment when jamming (so-called paper jam) of the recording medium is caused between the recording head and the platen roller, and in a case of replacement and maintenance of the recording head and/or the platen roller, the operations are extremely hard to perform in a state where the recording head and the platen roller remain in contact with each other in the casing. Accordingly, there is provided a construction in which the platen roller and the recording head are separated from each other and one of the platen roller and the recording head is exposed to the exterior of the casing.

In the construction disclosed in Patent Document 1, it is possible for the recording head disposed in the casing to swing and be separated from the platen roller. The platen roller is hardly moved in the casing.

On the other hand, it is desirable for the recording head, which has a plurality of recording elements (for example, heat generating elements), to be almost fixed in position inside the casing so as not to impair the reliability in electrical connection for inputting recording signals for selectively driving the recording elements. Therefore, there is a construction in which the platen roller is separated from the recording head and is exposed to the exterior, with the recording head being almost fixed in position inside the casing. For example, in some constructions, there is provided a slit-like notch, which is notched toward the outside, in a frame, and a shaft portion (portion to be retained) of the platen roller is retained in the notch to thereby perform positioning. In this case, an opening portion of the notch which opens toward the exterior is an entrance portion through which the platen roller is let in and out. This construction is advantageous in that the platen roller can be attached/detached. While, the construction requires a structure for firmly retaining the platen roller at a predetermined retaining position so that the platen roller does not inadvertently escape from the notch and the platen roller is brought into contact with the recording head with the predetermined pressure during the recording operation.

As the structure for preventing the platen roller from inadvertently escaping from the notch, there is a construction in which the shaft portion of the platen roller is retained in the notch by means of a member surrounding the same, that is, a construction in which at least a part of the opening portion of the notch (entrance portion for platen roller) is blocked to thereby prevent the shaft portion of the platen roller from escaping from the notch. The member for blocking the opening portion of the notch may be the recording head itself (Patent Document 2), or a dedicated lock arm for retaining the shaft portion of the platen roller may be used in addition to the recording head (Patent Document 3). In this construction, by moving the member surrounding the shaft portion of the platen roller (recording head or lock arm), the opening portion of the notch is opened, and attachment/detachment of the platen roller becomes possible.

[Patent Document 1] JP 10-119326 A

[Patent Document 2] JP 08-505576 A

[Patent Document 3] JP 2000-318260 A

In the constructions described in Patent Documents 2 and 3, the platen roller is exposed to the exterior of the casing by moving the platen frame, with the recording head being almost fixed in the casing. Accordingly, the constructions are advantageous in that it is possible to easily perform operations such as setting of the recording medium, jam treatment for taking out a jammed recording medium, and replacement and maintenance of the recording head and/or the platen roller. However, the constructions are inevitably complicated. In order to expose a part of the platen roller and the platen frame to the outside, it is necessary to employ a construction in which a door portion, which can be opened and closed, is provided to the casing positioned outside the platen roller and the platen frame, the door portion is opened and the platen frame is moved to thereby move a part of the platen roller and the platen frame to the outside. Specifically, in the casing of the recording unit for containing a recording unit including the platen retaining structure, it is necessary to provide the door portion corresponding to the platen frame, and the casing should be designed for each type of the platen retaining structures.

On the other hand, in a case of simplifying the construction of the recording unit and simplifying the design and production of the casing to thereby reduce costs, as in Patent Document 1, the construction in which the platen roller is not exposed to the outside is still employed in some cases.

Specifically, at present, there are both types of the recording unit having a construction in which the platen roller is not exposed to the exterior of the casing by placing high priorities on the simplification of the construction and the reduction in costs, and the recording unit having a construction in which a part of the platen roller and the platen frame is exposed to the exterior of the casing by placing priorities on easiness for the operations such as maintenance. There are employed a recording unit to be contained in the former recording unit and a recording unit to be contained in the latter recording unit, which are individually designed. In the recording unit contained in the former recording unit, mainly by detecting the position of the recording head, it is detected whether the recording unit is in a recordable state. While, in the recording unit contained in the latter recording unit, mainly by detecting the position of the platen roller, it is detected whether the recording unit is in a recordable state.

SUMMARY OF THE INVENTION

Therefore, it is an object of the present invention to provide a versatile platen retaining structure which can be used for both of the recording unit having the construction in which the platen is not exposed to the exterior of the casing and the recording unit having the construction in which a part of the platen and the platen frame is exposed to the exterior of the casing, and a recording unit including the same.

A platen retaining structure according to the present invention is characterized by including: a head for performing processing on a sheet material; a platen facing the head, for supporting the sheet material by sandwiching the sheet material when the sheet material is to be processed by the head; a platen frame having an elongated hole-like recess in which a portion to be retained in the platen is inserted and retained so as to be movable inside thereof; a release arm engaged with the platen and capable of moving with the platen; a drive member for moving the release arm along with movement of the head; and a switch used for position detection which detects movement of the platen or the release arm.

This structure can be used for the recording unit having the construction in which a part of the platen and the platen frame is exposed to the exterior of the casing, and can be used also for the recording unit having the construction in which the platen and the platen frame are not exposed to the exterior of the casing. In both cases, movement of the platen or the release arm is detected by the switch used for position detection, and a detection result is used for determination on whether the recording unit is in a recordable state or not. In the case of the recording unit having the construction in which the platen and the platen frame are not exposed to the exterior of the casing, the platen frame is hardly moved, but the portion to be retained in the platen is moved in the elongated hole-like recess. Accordingly, the platen and the release arm can be moved within a range in which the portion to be retained can be moved in the recess, and the movement can be detected by the switch used for position detection.

Conventionally, in the construction in which the platen frame is not moved, the platen is not moved either, and a movable member like the release arm does not exist, so the position detection is impossible. Therefore, in order to judge whether the recording unit is in a recordable state or not, the switch used for position detection cannot be avoided to be provided on the head side. As a result, the construction is disadvantageous in that the space efficiency deteriorates. If the recording unit provided with the switch used for position detection on the head side is diverted to the recording unit having the construction in which the platen frame is to be moved (is to be exposed to the exterior of the casing), the head is hardly moved, so there is no point in providing the switch used for position detection on the head side. In order to judge whether the recording unit is in a recordable state or not, the switch used for position detection cannot be avoided to be provided on the platen frame side. Specifically, in order to judge whether the recording unit is in a recordable state or not (judge whether the platen and the head are disposed at appropriate positions), in the recording unit having the construction in which the platen frame cannot be moved (is not to be exposed to the outside), it is necessary to provide the switch used for position detection on the head side. While, in the recording unit having the construction in which the platen frame is to be moved (is to be exposed to the exterior of the casing), it is necessary to provide the switch used for position detection on the platen frame side. Accordingly, unless two or more switches are provided, a versatile recording unit, which can be used for both types of the recording unit, cannot be produced.

On the other hand, in the construction of the present invention, the switch for detecting the movement of the platen or the release arm is provided on the platen frame side. Therefore, the construction can be used for the recording unit having the construction in which the platen frame is to be moved (is to be exposed to the exterior of the casing), as a matter of course. In addition, the portion to be retained in the platen can be moved in the elongated hole-like recess provided in the platen frame, and the platen and the release arm can also be moved within the range in which the platen frame can be moved. Accordingly, also in the recording unit having the construction in which the platen frame cannot be moved (is not to be exposed to the outside), a relative positional relationship between the head and the platen can be detected by the switch provided on the platen frame side, and it is unnecessary to provide the switch on the head side. Thus, the recording unit of the present invention has versatility and can be used for both types of the recording unit.

It should be noted that the drive member may include urging means provided between the head and the release arm, for applying an urging force to the release arm to move the portion to be retained in the platen, which is engaged with the release arm by the urging force when a pressing force applied from the head to the release arm through the platen is released.

Further, the drive member may include a connecting member provided between the head and the release arm, for moving the release arm in synchronization with movement of the head.

A recording unit according to the present invention which is used by being contained in the recording unit is characterized by including one of the platen retaining structures described above, in which the head is a recording head for recording on the sheet material.

According to the present invention, it is possible to realize a versatile recording unit which can be used for both of the recording unit having the construction in which a part of the platen and the platen frame is to be exposed to the exterior of the casing, and the recording unit having the construction in which the platen and the platen frame are not to be exposed to the exterior of the casing. In the recording unit, only by the switch used for position detection, which detects the movement of the platen or the release arm, the relative positional relationship between the head and the platen can be detected in both types of the recording unit.

DETAILED DESCRIPTION OF THE PREFERRED EMBODIMENT

Hereinafter, an embodiment mode of the present invention will be described with reference to the drawings.

Figure 1A:
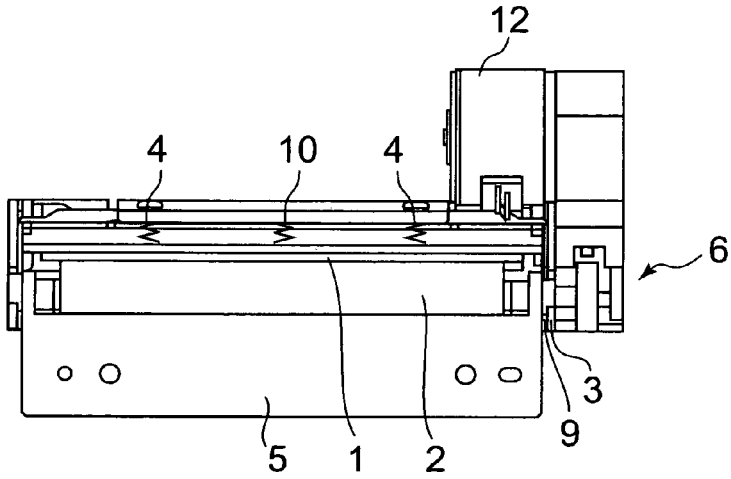
FIG. 1A is a plan view illustrating a main part of a recording unit including a platen retaining structure according to the present invention.
Figure 1B:
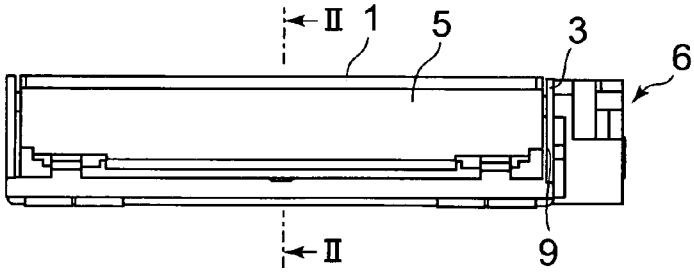
FIG. 1B is a front view thereof.
Figure 1C:
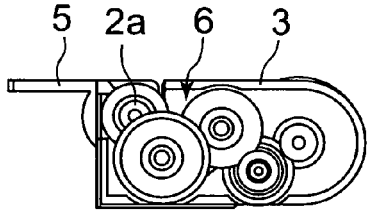
FIG. 1C is a side view thereof.
Figure 2:
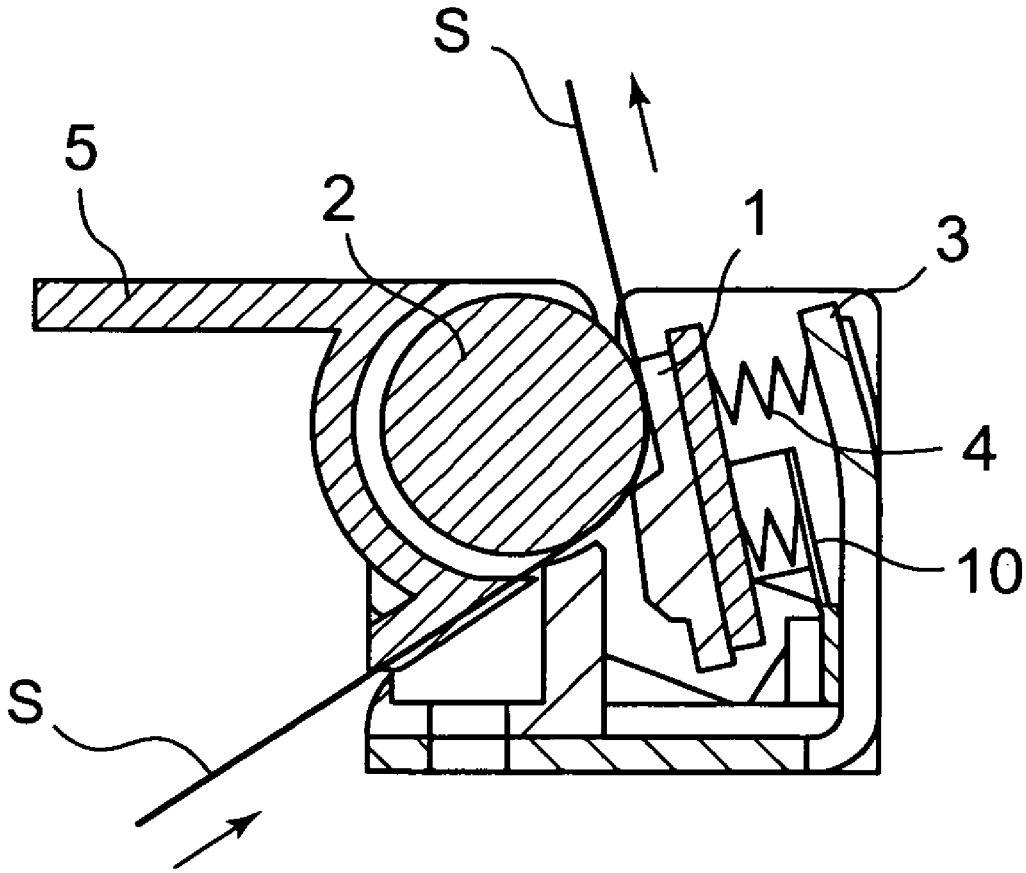
FIG. 2 is a cross sectional view taken along the line II-II of the recording unit shown in FIG. 1A-1C.

FIGS. 1A-1C and 2 show a main part of a recording unit in which a recording unit according to an embodiment of the present invention is contained. In the recording unit, which is in a recordable state, a thermal head 1 which is an example of a recording head for performing recording on a recording medium (sheet material) S as shown in FIG. 2, and a roller-type platen (platen roller 2) for transporting the recording medium S are arranged to be adjacent to each other. Although not shown in the figure, the thermal head 1 includes a large number of heat generating elements and an electrical connection mechanism for transmitting drive signals so as to selectively drive the heat generating elements. Between the thermal head 1 and the frame 3, there is provided a spring member 4 serving as a first urging means for urging the thermal head 1 to be in press contact with the platen roller 2. The platen roller 2 includes a shaft portion 2*a* and an outer peripheral portion 2*b* formed of an elastic body. The thermal head 1 and the platen roller 2 constitute a recording portion.

The thermal head 1 is mounted to the frame 3 such that the thermal head 1 can be moved by a small displacement (for example, several millimeters) in a range of elastic deformation of the spring member 4, for example. The platen roller 2 is mounted to a platen frame 5 so as to be rotatable. In addition, the platen frame 5 is mounted so as to be capable of moving (for example, swingably) with respect to the frame 3. On a side of the frame 3, there is provided a gear group 6 for transmitting a rotational driving force from a motor (drive means) 12 to the platen roller 2.

Figure 3A:
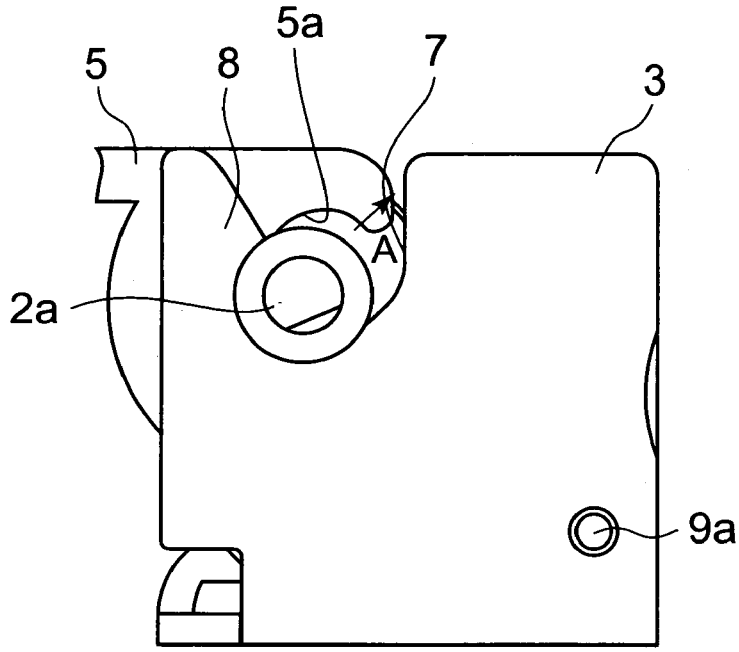
FIG. 3A is a side view illustrating a recordable state of the platen retaining structure of the recording unit shown in FIG. 1A-1C.

As shown in FIG. 3A, the frame 3 has a notch 7 formed therein which is notched from the retaining position where the platen roller 2 should be retained during recording, toward outside. In the vicinity of an opening portion of the notch 7, a pawl 8 protruding toward the inside is formed. By the pawl 8, an escaping direction from the retaining position to the opening portion in the notch 7 is restricted to a direction indicated by the arrow A (to be exact, direction within a range of a small angle containing the direction of the arrow A, but in this case, is referred to as "direction of arrow A" for convenience). As a matter of course, an advancing direction into the notch 7 is restricted to an opposite direction of the direction of the arrow A.

As described above, the platen roller 2 is retained in the platen frame 5 so as to be rotatable. Specifically, the platen roller 2 is retained such that the shaft portion 2*a* of the platen roller 2 is inserted in a slit-like recess 5*a* provided in the platen frame 5. The shaft portion 2*a* is retained such that the shaft portion 2*a* can be moved within the slit-like recess 5*a* (elongated-hole like plate) and cannot escape from the recess 5*a* as long as an external force is not applied. Thus, the shaft portion 2*a* functions as a portion to be retained in the platen roller 2. The platen frame 5 is mounted so as to be movable with respect to the frame 3. The frame 3 is mounted with a release arm 9 which is swingable with a rocking shaft 9*a* as a center. The release arm 9 includes an engagement portion 9*b* which is engaged with the shaft portion 2*a* of the platen roller 2. In addition, between the release-arm 9 and the thermal head 1, a spring member 10 serving as a second urging means is provided. The spring member 10 serves as the drive member of the present invention.

A switch 11 for position detection is fixed to the frame 3. The switch 11 is switched between an on-state and an off-state, that is, between a case where an intercept 11*a* is brought in contact with the release arm 9 and a case where the intercept 11*a* is not in contact with the release arm 9.

With the above-mentioned structure, in an assembled state shown in FIGS. 1A-1C to 3A-3B, when the sheet material S serving as a thermal recording medium is supplied, the sheet material S is transported through rotation of the platen roller 2 which is driven by the motor 12 through the gear group 6. In this case, the thermal head 1 is urged against the platen roller 2 by the spring member 4, thereby sandwiching the sheet material S between the thermal head 1 and the platen roller 2. Then, the driving signal is transmitted from the electrical connection mechanism not shown to the heat generating element of the thermal head 1 to drive the thermal head 1, thereby performing desirable recording on the sheet material S.

In the recording unit, the shaft portion 2*a* of the platen roller 2 is positioned in the slit-like recess 5*a* of the platen frame 5 and in the notch 7 of the frame 3. When the spring member 4 applies the pressing force to the platen roller 2 through the thermal head the shaft portion 2*a* is pressed at retaining positions shown in FIGS. 3A-3B to be retained. A direction in which the shaft portion 2*a* can escape from the notch 7 is substantially regulated only in the direction of the arrow A by the pawl 8. At least part of the pressing force (urging force) applied by the spring member 4 to the platen roller 2 through the thermal head 1 acts from an opposite side of the direction of the arrow A. Accordingly, by the urging force of the spring member 4, the platen roller 2 and the shaft portion 2*a* are pressed at the retaining positions shown in FIGS. 3A-3B, and are not made apart from the retaining position. It should be noted that, in this state, the intercept 11*a* of the switch 11 is in a state of being in contact with the release arm, and can detect that the platen roller 2 is positioned at the retaining position.

Figure 3B:
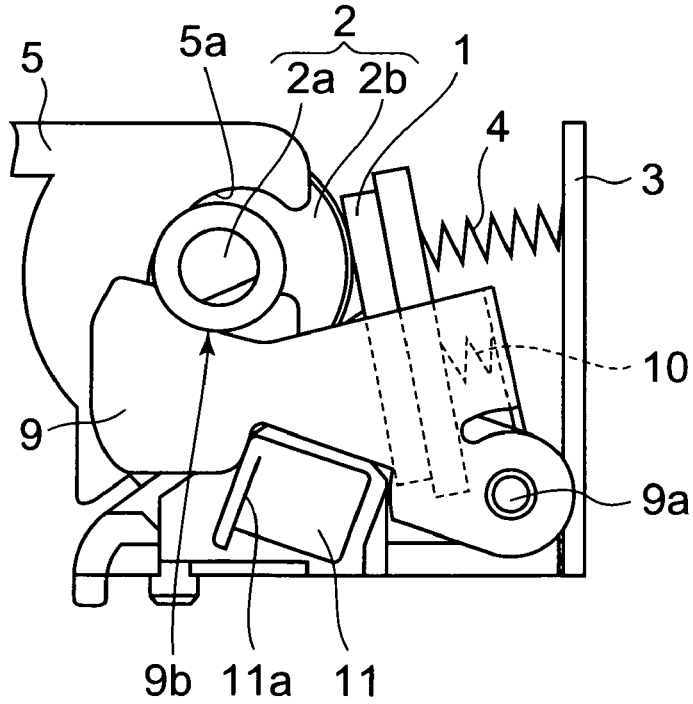
FIG. 3B is a side view thereof in which a part of a frame is omitted from showing.
Figure 4A:
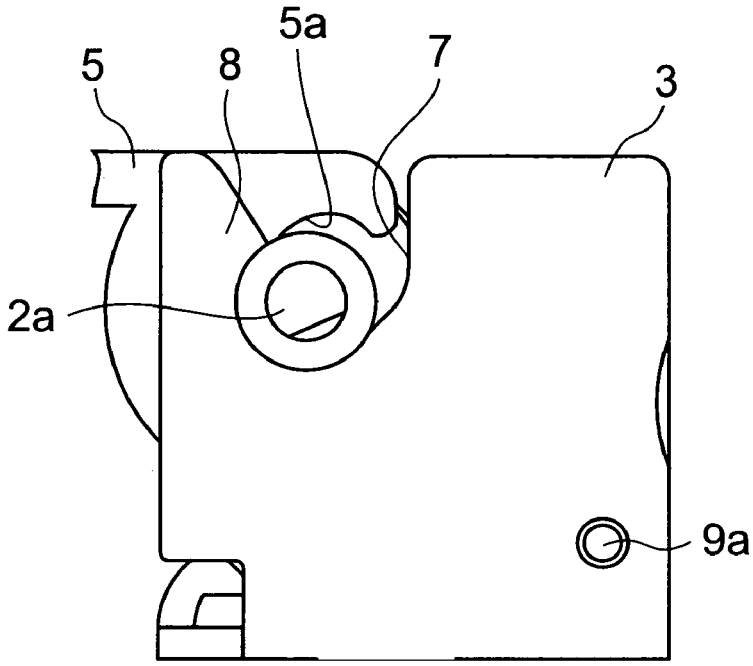
FIG. 4A is a side view illustrating the platen retaining structure of the recording unit shown in FIG. 1A-1C, with a head being moved.
Figure 4B:
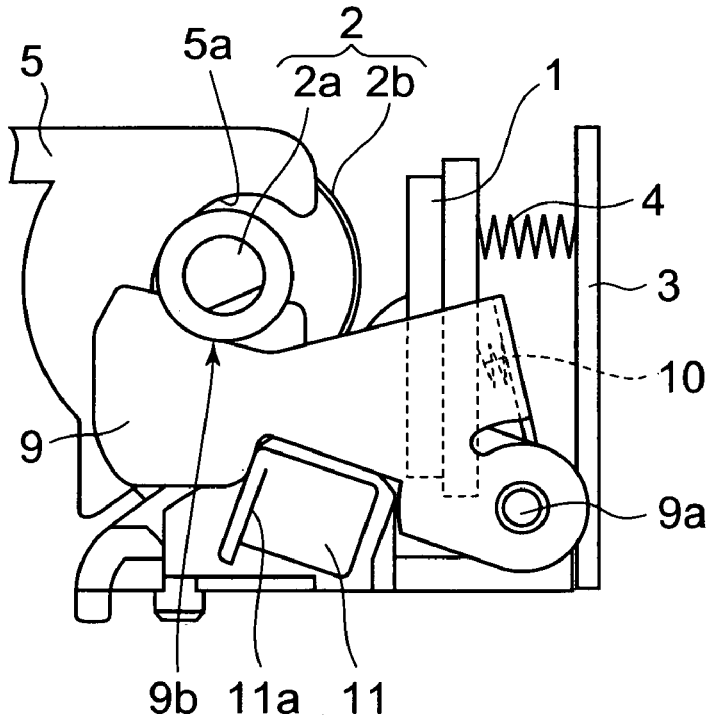
FIG. 4B is a side view thereof in which a part of the frame is omitted from showing.
Figure 5A:
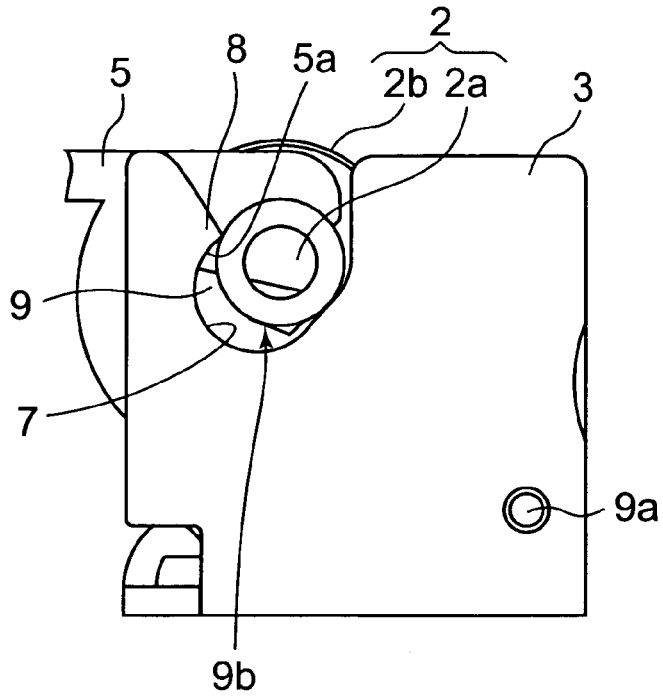
FIG. 5A is a side view illustrating a state of the platen retaining structure of the recording unit shown in FIG. 1A-1C, with a release arm being moved.
Figure 5B:
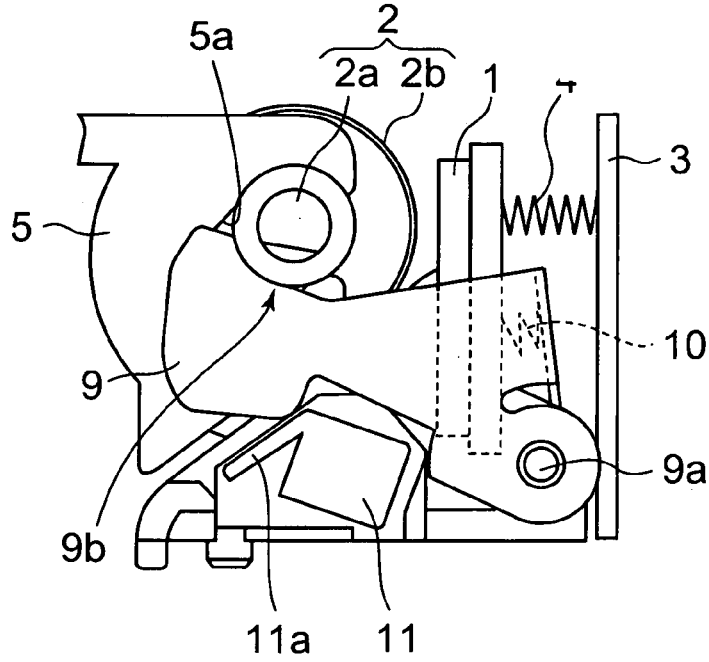
FIG. 5B is a side view thereof in which a part of the frame is omitted from showing.
Figure 6A:
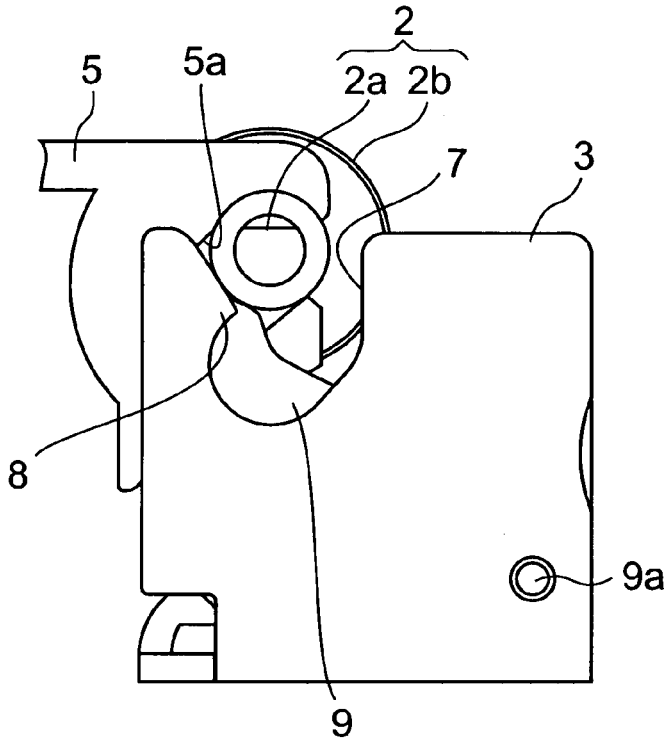
FIG. 6A is a side view illustrating a state of the platen retaining structure of the recording unit shown in FIG. 1A-1C, with a platen being taken out.
Figure 6B:
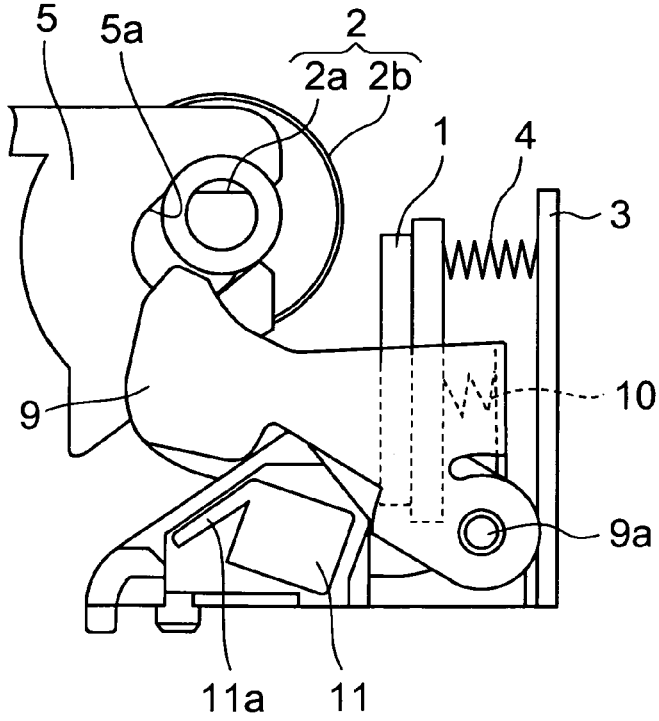
FIG. 6B is a side view thereof in which a part of the frame is omitted from showing.

During a non-recording time, in a case of performing operations such as setting the recording medium by inserting it between the thermal head 1 and the platen roller 2, jamming treatment when jamming (so-called paper jam) of the recording medium is caused between the thermal head 1 and the platen roller 2, and replacement and maintenance of the thermal head 1 and/or the platen roller 2, the platen roller 2 is separated from the thermal head 1 to be exposed to the outside. In this case, according to this embodiment, first, a lever or the like not shown is operated, and the thermal head 1 is separated from the platen roller 2 against the urging force of the spring member 4 (see FIGS. 4A-4B). At this time, actually, the release arm 9 connected to the thermal head 1 through the spring member 10 is moved in synchronization with the movement of the thermal head 1. In other words, actually, states shown in FIGS. 4A-4B are not obtained, and as shown in FIGS. 5A-5B, the thermal head 1, the spring member 10, and the release arm 9 are moved together. At this time, the engagement portion 9*b* of the release arm 9 is engaged with the shaft portion 2*a* of the platen roller 2 to move the platen roller 2 and the release arm 9 together. As a result, the platen roller 2 is apart from the retaining positions shown in FIGS. 1A-1C to 3A-3B, and the shaft portion 2*a* is moved to the vicinity of the opening position of the notch 7. At this position, a part of the shaft portion 2*a* is positioned on the outside of the pawl 8, and can be released from the regulation by the pawl 8. Then, the platen frame 5 is moved with respect to the frame 3 to cause the shaft portion 2*a* of the platen roller 2 to completely escape from the notch 7 of the frame 3 as shown in FIG. 6A-6B. In the states shown in FIGS. 5A-5B and 6A-6B, the intercept 11*a* of the switch 11 is not in contact with the release arm, and can detect that the platen roller 2 is not positioned at the retaining position, that is, an unrecordable state.

It should be noted that, FIGS. 4A-4B show the states which are hardly obtained in reality in this embodiment, as described above, but are reference figures for explanation of the movement of the thermal head 1.

After that, the operations such as setting of the recording medium and a jam treatment process, and replacement and maintenance of the thermal head 1 and/or the platen roller 2 are performed. If necessary, the platen roller 2 may be allowed to escape from the slit-like recess 5*a* of the platen frame 5. However, a structure and a method for escaping the platen roller 2 from the recess 5*a* of the platen frame 5 do not constitute features of the present invention, and various conventionally-known means can be employed, so the explanation thereof is omitted.

It should be noted that, in a case where the platen roller 2 is inserted into the retaining position of the notch 7 as shown in FIGS. 1A-1C to 3A-3B from the state where the platen roller 2 is taken out of the notch 7, the platen roller 2 may be pushed therein so that the shaft portion 2*a* is placed in the opening portion of the notch. In other words, when the platen roller 2 is pushed therein, the thermal head 1 is pushed by the platen roller 2 and moves by a small distance against the urging force of the spring member 4, thereby inserting the platen roller 2 into the notch. Then, the thermal head 1 is restored by the urging force of the spring member 4 to press the platen roller 2, thereby pressing the shaft portion 2*a* at the retaining position to be fixed. The fixation is performed against the urging force of the spring member 10. Therefore, with regard to at least a component force in the advancing and escaping directions of the shaft portion 2*a*, it is necessary that the urging force of the spring member 4 to be larger than the urging force of the spring member 10.

In the construction described above, as long as the thermal head 1 is made apart from the platen roller 2 by a small distance (about several mm) through an operation of a lever or the like (not shown), the platen roller 2 is moved by the urging force of the spring member 10 and the shaft portion 2*a* escapes from the notch, thereby making it possible to take out the platen roller 2 to the outside. In this case, the operator is not required to directly apply a force for moving the platen roller 2.

In this embodiment, the switch 11 for position detection is used to detect whether the recording unit is in a recordable state. As shown in FIG. 3B, the switch 11 has the intercept 11*a* which is in contact with the release arm 9 in a state where the release arm 9 is pressed against the urging force of the spring member 10 by the urging force (pressing force) applied from the spring member 4 through the thermal head 1 and the platen roller 2. At this time, the outer peripheral portion 2*b* of the platen roller 2 is brought into contact with the thermal head 1, so it is apparent that the recording unit is in a recordable state.

On the contrary, as shown in FIGS. 5A-5B and 6A-6B, in a state where the urging force (pressing force) transmitted from the spring member 4 to the platen roller 2 is released by moving the thermal head 1, the release arm 9 is moved to carry the shaft portion 2*a* of the platen roller 2 to the opening portion side of the notch 7 by the urging force of the spring member 10. Through the movement, the intercept 11*a* is not in contact with the release arm 9. At this time, the outer peripheral portion 2*b* of the platen roller 2 is not brought into contact with the thermal head 1, so it is apparent that the recording unit is in an unrecordable state.

As described above, in this embodiment, by the switch 11 having the intercept 11*a* brought into contact with the release arm 9, it is possible to detect whether the recording unit is in a recordable state (state where the outer peripheral portion 2*b* of the platen roller 2 is brought into contact with the thermal head 1 and the platen roller 2 is disposed at a position where a carrying force can be transmitted). The switch 11 can be disposed at a relatively free position, not on the thermal head 1 side (right side of the figure) but on the platen frame 5 side (left side of the figure). Therefore, the space efficiency for the recording unit is satisfactory. It should be noted that, in place of the construction in which the intercept 11*a* is contacted/separated to/from the release arm 9, a construction in which the intercept 11*a* is contacted/separated to/from the platen roller 2 itself can be employed.

The above description relates to the construction in which a part of the platen frame 5 is exposed to the exterior of the casing of the recording unit as shown in FIGS. 6A-6B, in a case where, though not shown in the figure, a door portion which can be opened and closed so as to correspond to the movement of the platen frame 5 is provided to the casing.

Also when a part of the platen frame 5 is not exposed to the exterior of the casing of the recording unit, that is, when the door portion is not provided to the casing, the recording unit itself of this embodiment is the same as that described above, so the same states as shown in FIGS. 3A-3B to 5A-5B are obtained. In addition, the casing has no door portion and the movement of the platen frame 5 is regulated, so the state shown in FIGS. 6A-6B cannot be obtained. Specifically, the construction in which a part of the platen frame 5 is not to be exposed to the exterior of the casing of the recording unit. In other words, the construction in which the door portion is not provided to the casing is the same as the construction in which a part of the platen frame 5 is to be exposed to the exterior of the casing of the recording unit, that is, the construction in which the door portion is provided to the casing, except that the state shown in FIGS. 6A-6B is not obtained. In other words, the recording unit of this embodiment can be versatilely used for the recording units having those constructions.

In particular, conventionally, in the construction in which the platen frame 5 is not moved, the switch 11 for detecting whether the recording unit is in a recordable state or not (state where the outer peripheral portion 2*b* of the platen roller 2 is brought into contact with the thermal head 1 and the platen roller 2 is disposed at a position where a carrying force can be transmitted) is inevitably provided so as to be contacted/separated to/from the thermal head 1 to detect the movement of the thermal head 1. For this reason, it is necessary to secure a space for the switch 11 on the thermal head 1 side (right side of the figure), which deteriorates the space efficiency. On the other hand, in this embodiment, even in the construction in which the platen frame 5 is not to be moved, the platen roller 2 can be moved in the elongated hole-like recess 5*a* and the release arm 9 is to be moved in association with the platen roller 2. Accordingly, by detecting the movement of the release arm 9 or the platen roller 2, it is possible to detect whether the recording unit is in a recordable state, with the result that the switch 11 can be provided at a relatively free position on the platen frame 5 side (left side of the figure), thereby enhancing the space efficiency.

It should be noted that, when the platen roller 2 is moved or removed, the thermal head 1 may be returned to the position shown in FIGS. 3A-3B by the spring force of the spring member 4. In this case, the thermal head 1 is disposed at the predetermined position but is not in contact with the platen roller 2, so the recording unit is in an unrecordable state. Also in this case, the switch 11 of this embodiment has a construction, for detecting the movement of the release arm 9 or the platen roller 2, thereby enabling appropriate judgement that recording is impossible. As a matter of course, in the construction in which the platen roller 2 is also returned to the predetermined position at the same time when the thermal head 1 is returned to the predetermined position, the unrecordable state is not obtained.

In the embodiment as described above, the spring member 4 is disposed, as the first urging member, between the thermal head 1 and the frame 3. It is preferable that the spring member 4 be disposed such that the urging direction thereof is set as a direction in which the spring member 4 applies the pressing force to the platen roller 2 through the thermal head 1 to press the shaft portion 2*a* of the platen roller 2 at the retaining position in the notch 7. It is necessary that the urging force of the spring member 4 have at least a component force in the direction.

In addition, the spring member 10 is disposed, as the second urging member, between the release arm 9 and the thermal head 1. It is preferable that the spring member 10 be disposed such that the urging direction thereof is set as a direction in which the urging force applied from the spring member 4 to the platen roller 2 through the thermal head 1 is released, and when the thermal head 1 is separated from platen roller 2, the pressing force is applied to the platen roller 2 through the release arm 9 to move the shaft portion 2*a* of the platen roller 2 in the escaping direction from the notch 7. At least the urging force of the spring member 10 is required to have a component force in the direction. As a result, the release arm 9 can apply the pressing force in the direction in which the shaft portion 2*a* escapes from the notch 7 with respect to the platen roller 2 along with the movement of the thermal head 1 against the urging force of the spring member 4.

Figure 7A:
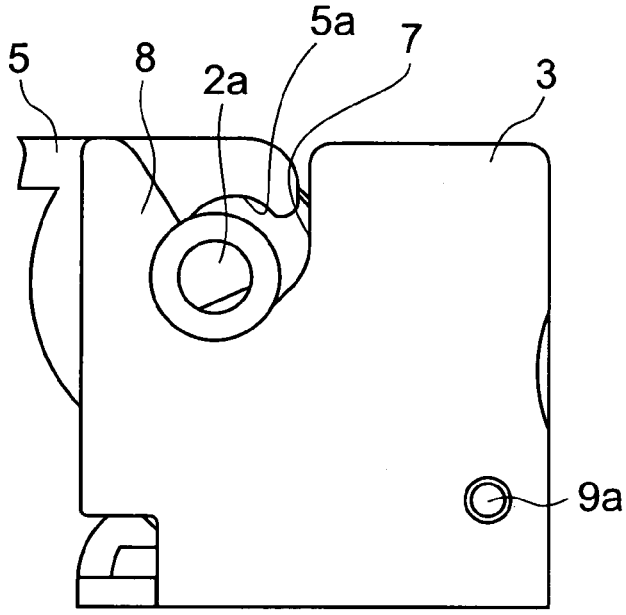
FIG. 7A is a side view illustrating a recordable state of the platen retaining structure of a modified example of the recording unit shown in FIG. 1A-1C.
Figure 7B:
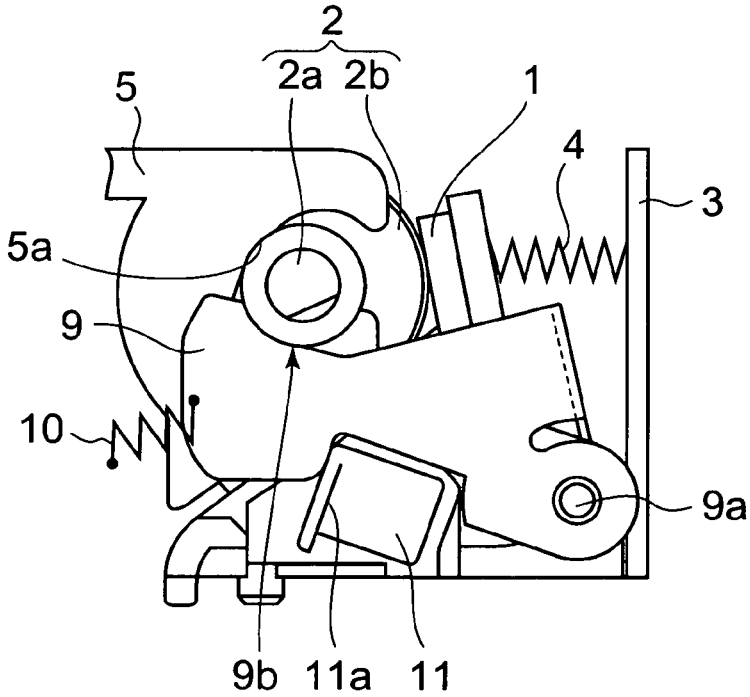
FIG. 7B is a side view thereof in which a part of the frame is omitted from showing.

Note that, for example, as shown in FIGS. 7A-7B, it is also possible to employ a structure including the spring member 10 disposed between the release arm 9 and the frame 3, and having the same urging direction as described above. In this case, the spring member 10 is a compression spring. It should be noted that in FIGS. 7A-7B, a portion of the frame 3 for fixing the spring member 10 is not shown in the figure.

Alternatively, a connecting member for connecting the thermal head 1 and the release arm 9 can be used in place of the spring member 10. In this case, the urging force is not obtained, but the release arm 9 can be moved by following the movement of the thermal head 1 departing from the platen roller 2, and the shaft portion 2*a* engaged with the engagement portion 9*b* can be moved to the opening portion side of the notch 7. In this structure, the urging force (spring force) is not particularly necessary, and the states as shown in FIGS. 5A-5B can be obtained.

It should be noted that, in place of the platen roller 2, a non-roller type platen can be used. In this case, the portion to be retained to be held in the notch 7 is no limited to a shaft type, but protrusions having various shapes can be adopted.

The head is not limited to a recording head such as a thermal head, but a head for thermal activation may be used.

What is claimed is:

1. A platen retaining structure, comprising:

a head for performing processing on a sheet material;

a platen facing the head, for supporting the sheet material by sandwiching the sheet material when the sheet material is to be processed by the head;

a platen frame having an elongated hole-like recess in which a portion to be retained in the platen is inserted and retained so as to be movable inside thereof;

a release arm engaged with the platen and capable of moving with the platen;

a drive member for moving the release arm along with movement of the head; and a switch used for position detection, which detects movement of the platen or the release arm.

2. A platen retaining structure according to claim 1, wherein the drive member comprises urging means provided between the head and the release arm, for applying an urging force to the release arm to move the portion to be retained in the platen, which is engaged with the release arm by the urging force when a pressing force applied from the head to the release arm through the platen is released.

3. A recording unit, comprising the platen retaining structure according to claim 2, wherein the head comprises a recording head for recording on the sheet material.

4. A platen retaining structure according to claim 1, wherein the drive member comprises a connecting member provided between the head and the release arm, for moving the release arm in synchronization with movement of the head.

5. A recording unit, comprising the platen retaining structure according to claim 4, wherein the head comprises a recording head for recording on the sheet material.

6. A recording unit, comprising the platen retaining structure according to claim 1, wherein the head comprises a recording head for recording on the sheet material.

* * * * *